US006360665B1

(12) United States Patent
Hartmann et al.

(10) Patent No.: US 6,360,665 B1
(45) Date of Patent: Mar. 26, 2002

(54) METHOD AND DEVICE FOR DRAWING IN A STRIP OF MATERIAL

(75) Inventors: Manfred Wolfgang Hartmann, Elfershausen; Horst Bernhard Michalik, Höchberg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/423,663

(22) PCT Filed: May 20, 1998

(86) PCT No.: PCT/DE98/01384

§ 371 Date: Nov. 22, 1999

§ 102(e) Date: Nov. 22, 1999

(87) PCT Pub. No.: WO98/52754

PCT Pub. Date: Nov. 26, 1998

(30) Foreign Application Priority Data

May 21, 1997 (DE) ..... 197 21 212

(51) Int. Cl.[7] ..... B41C 1/04
(52) U.S. Cl. ..... 101/483; 101/484
(58) Field of Search ..... 101/483, 484, 101/485, 227, 228, 233, 232, 226

(56) References Cited

U.S. PATENT DOCUMENTS

| | | | | |
|---|---|---|---|---|
| 3,761,001 A | | 9/1973 | Bolza-Schunemann et al. | 226/92 |
| 4,573,954 A | * | 3/1986 | Berger et al. | 493/55 |
| 5,085,377 A | | 2/1992 | Rohrer et al. | 242/58.6 |
| 5,088,403 A | | 2/1992 | Shoji et al. | 101/227 |
| 5,178,063 A | * | 1/1993 | Wolfberg et al. | 101/226 |
| 5,203,962 A | * | 4/1993 | Renquist | 162/4 |
| 5,289,770 A | | 3/1994 | Hern | 101/216 |
| 5,436,844 A | | 7/1995 | Tokiwa | 700/122 |
| 5,483,893 A | | 1/1996 | Isaac et al. | 101/485 |
| 5,542,350 A | | 8/1996 | Theilacker et al. | 101/228 |
| 5,546,859 A | | 8/1996 | Hern | 101/226 |

FOREIGN PATENT DOCUMENTS

| | | |
|---|---|---|
| DE | 2021246 | 4/1970 |
| DE | 2241127 | 3/1974 |
| DE | 4327211 A1 | 3/1994 |
| DE | 4318299 A1 | 12/1994 |
| EP | 0223405 A1 | 5/1987 |
| EP | 0390735 A3 | 10/1990 |
| JP | 62-101442 | 5/1987 |
| JP | 9-99548 | 4/1997 |

* cited by examiner

*Primary Examiner*—John S. Hilten
*Assistant Examiner*—Anthony H. Nguyen
(74) *Attorney, Agent, or Firm*—Jones, Tullar & Cooper, PC

(57) ABSTRACT

Coded retrievable signal information is applied to a paper web leading end prior to the paper web being directed to a print unit in a rotary, web-fed printing press. This signal information is scanned by signal reading devices and is forwarded to adjusting elements along the path of travel of the web through the press. These adjusting elements set the path of web travel to its final destination and also synchronize the printing units and the cutting units for the paper web.

10 Claims, 1 Drawing Sheet

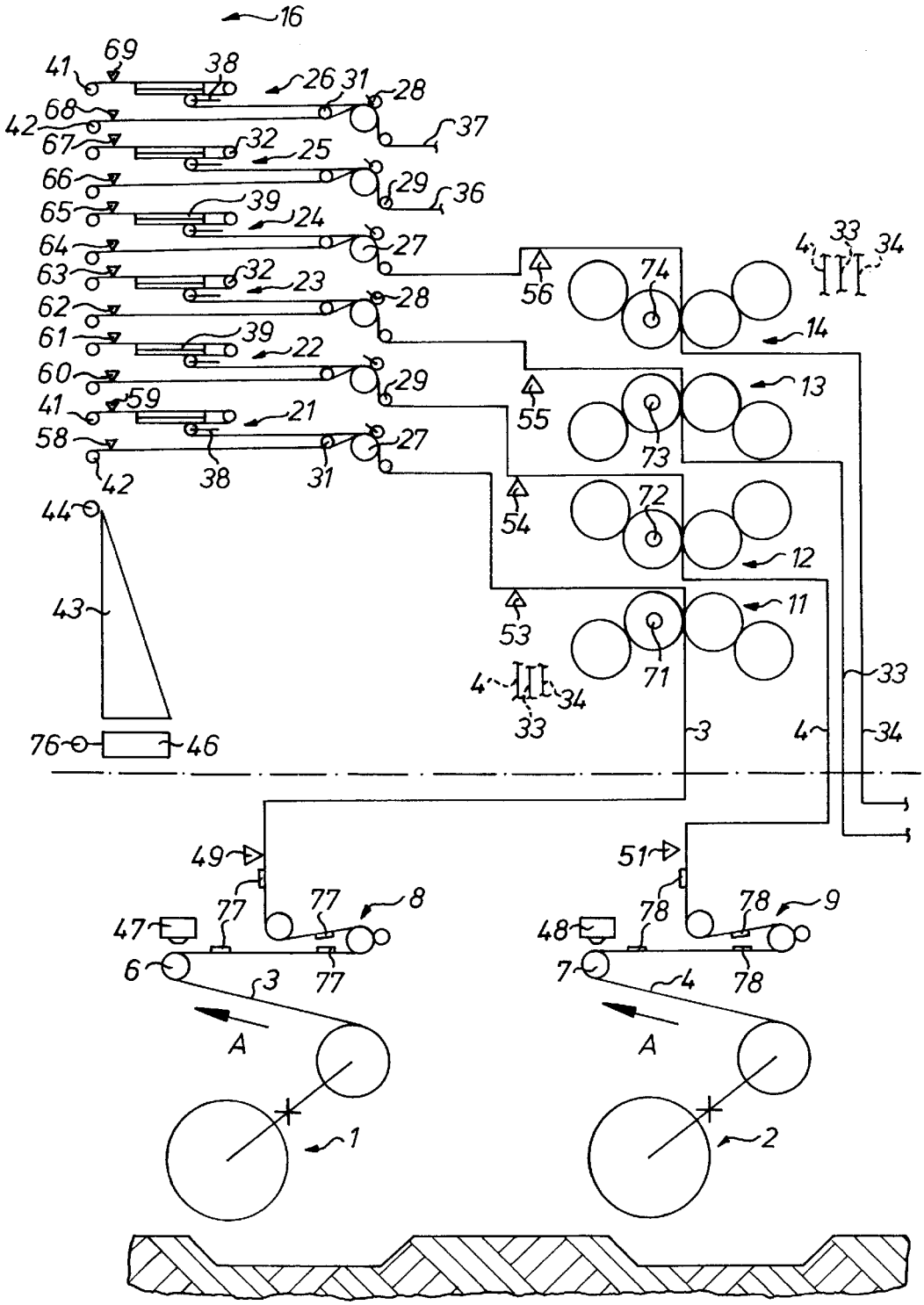
16
41
69
38
26
31
28
42
68
37
67
32
25
66
29
36
65
39
24
64
27
63
32
23
62
28
61
39
22
60
29
41
59
21
58
27
42
38
31
44
43
76
46
56
74
14
55
73
13
54
72
12
53
71
11
4
33
34
3
4
34
49
51
77
8
78
9
47
48
6
7
3
4
A
A
1
2

METHOD AND DEVICE FOR DRAWING IN A STRIP OF MATERIAL

FIELD OF THE INVENTION

The present invention relates to a method and to a device for drawing a web of material into a web-fed rotary printing press. The web of material is provided with coded information that is used to actuate web guidance devices that will deliver the web to a desired destination.

DESCRIPTION OF THE PRIOR ART

A draw-in device for drawing several paper webs into a web-fed rotary printing press is known from DE 43 18 299 A1. In this device, paths of different length must be traveled. An electronic memory, in which all of the different guide paths are stored, is used in this prior device.

It is a limitation of this prior draw-in device that, for example, the coupling positions and the register settings can only be done after the paper webs have been guided through the web-fed rotary printing press and are each ready for printing. Further than that, after the press has been assembled in situ, it is initially necessary to provide the software for the paper draw-in system and control system and to operate it. This is very time-consuming and costly.

U.S. Pat. No. 5,088,403 A describes a web-fed rotary printing press, wherein a paper web is provided with markings for checking web paths.

DE 2021246 A shows a device for drawing a paper web in by means of a motorized carriage moving on selectable rails.

SUMMARY OF THE INVENTION

The object of the present invention is based on creating a method and a device for drawing a web of material into a web-fed rotary printing press.

In accordance with the present invention, this object is attained by providing the web of material with at least one piece of coded information. This coded information is read by signal reading devices that operate actuating components of web guidance devices so that the web will be drawn into the rotary printing press and will guided to its desired destination.

The advantages which can be obtained by the present invention consist, in particular, in that it is not necessary to calculate or measure the length of the paper web paths. Instead, it is only required to apply a code for a destination to the paper web, and the start of the paper web reaches its preset destination by means of a known draw-in device. The print unit is already synchronized during the draw-in process of the paper web, or a longitudinal register roller is moved into position.

The arrangement in accordance with the present invention can also be employed as a mobile system for pre-setting the destinations of the paper web paths, in particular before the web-fed rotary printing press has been placed into printing operation. A rapid testing option of the paper web paths is provided in this way. Furthermore, a possible outage of the master computer, in connection with drawing in a fresh paper web, has no damaging effects. The errors, which are otherwise possibly contained in the software of the control in the course of calculating the length of the paper web paths and which only become obvious during production, are therefore avoided.

A BRIEF DESCRIPTION OF THE DRAWINGS

A preferred embodiment of the present invention is represented in the sole drawing FIGURE and will be described in greater detail in what follows. The sole drawing FIGURE shows a front view of a part of a web-fed rotary printing press in accordance with the present invention, in a schematic representation.

DESCRIPTION OF THE PREFERRED EMBODIMENT

A web-fed rotary printing press has, among other things, two unrolling devices 1, 2 for webs of material, for example two paper unrolling devices 1, 2, from which webs of material 3, 4, for example paper webs 3, 4, can be guided via paper guide rollers 6, 7 and draw-in units 8, 9 to one of the print units 11, 12, 13, 14, which are arranged on top of each other. A turning bar deck 16, with a total of six levels 21 to 26 arranged above each other, is located next to, or in close vicinity to, the print units 11 to 14. A drawing roller group 27, with longitudinal cutting devices 28, as well as a number of paper guide rollers 29, 31, 32, are located on each level 21 to 26.

Further paper webs 33, 34, 36, 37 are supplied to the turning bar deck 16 from paper unrolling devices, not specifically represented sole drawing FIGURE.

Viewed in the running direction of each of the paper web 3, 4, 33, 34, 36, 37, each paper guide roller 29 is located in front of each longitudinal cutting device 28 and guides one of the respective paper webs over its entire width. Subsequent to, or after the longitudinal cutting device 28, in the direction of paper web travel, the paper guide roller 31, 42 guides a first half of the longitudinally divided paper web, while the second longitudinally divided half of the paper web is guided between the paper guide rollers 32, 41 over turning bars 39 of a respective level 21 to 26. A side cutting register 38 is arranged or positioned in front of or before the paper guide roller 32. A longitudinal folding device 43 with a hopper inlet roller 44 is located underneath the paper guide rollers 41, 42 of the levels 21 to 26 of the turning bar deck 16. A folding cylinder group 46 with a delivery belt is arranged underneath the longitudinal folding device 43.

It is also possible to let the paper web 4, 33, 34 enter not at the right, but at the left of the print units 12 to 14, such as has been schematically depicted to the left next to the print unit 11. In this case, the paper webs 4, 33, 34 also exit from the print units 12 to 14 to the right above the print unit 14.

A signal output device 47 or 48, acting on the paper web 3 or 4, respectively as well as a signal reading device 49 or 51, are arranged in the movement direction of the paper webs 3 or 4, i.e. in front of the print unit 11, 12, as viewed in the production direction A. Viewed in the production direction A, these devices 47, 49, 48 51 are preferably arranged after or subsequent to each paper unrolling device 1, 2. The signal output devices 47, 48 can each consist of a bar code transmitter, and the signal reading devices 49, 51 can each consist of a bar code reader, for example a laser scanner. A second signal reading device 53, 54, 55 or 56 is arranged after the outlet from each print unit 11 to 14 respectively.

A third signal reading device 58 to 69, respectively is arranged in the same way at the outlet of each level 21 to 26 of the turning bar deck 16 in front of or before each paper guide roller 41, 42.

Each print unit 11 to 14 has at least one angle encoder 71 to 74 which, for example, is connected, fixed against relative rotation, on a rubber blanket cylinder. In the same way, the cutting cylinder, not specifically shown, of the folding cylinder group 46, for example, is also provided with an angle encoder 76, which is arranged fixed against relative rotation.

Draw-in of each paper web is performed by a generally known paper web draw-in arrangement, for example a finite roller chain running in C-shaped profiled rails fixed in place on the lateral frame, whose drive stations are arranged at a clear distance from each other, which distance is less than the length of the roller chain.

For example, by means of the signal output device 47, which may be for example a laser printer, the paper web 3 is provided with coded signal information 77, which can be called up, for example in the form of a bar code which is read by the first signal reading device 49. The signal reading device 49 is connected with actuating elements, not represented, for example pneumatic work cylinders for actuating the switches for the roller chain of the paper draw-in device, which unblock the preselected paper web path.

The signal information 77 contains, for example, actuating commands for the switches to the print unit 11, as well as actuating commands for the switches to the level 21 of the turning deck 16. After the signal information 77 on the start of the paper web 3 has passed through the print unit 11 and has reached the second signal reading device 53, the position of the signal output device 47 with respect to the print unit 11 is synchronized by means of the angle encoder 71 of the print unit 11, i.e. the signal output device 47 begins to print the signal information 77 on the paper web 3 always in the start-printing position of the print unit 11. Following synchronization, the signal information 77 is provided with additional coding by the signal output device 47, for example a transverse bar for the reference setting of the cutting register, as well as an oblique bar for the lateral position of the paper web 3.

Furthermore, the signal reading device 53 is in contact with actuating elements, not specifically represented, for example, work cylinders for draw-in switches, which unblock the preselected paper web path, for example to the first level 21 of the turning bar deck 16.

Following the longitudinal cutting of the paper web 3 and the turning of one half of the paper web 3, both halves of the paper web 3 are scanned by means of the third signal reading devices 58, 59, wherein it is determined whether the print image is located in the correct position. Here, the distance between the signal reading devices 58, 59 and the cutting location of the cutting cylinder, as well as the position of the folding cylinder group 46, are known.

If deviations of the print image are detected by the print reading device, the print unit 11 is advanced or retarded by the needed angle of rotation in accordance with the requirements by means of a known "electrical wave" of the drive of the web-fed rotary printing press. In connection with such deviations of the print image detected by the signal reading device 59, the register roller of the side cutting register 38 of the level 21 is adjusted.

The draw-in process of the paper web 4 takes place analogously with the draw-in process of the paper web 3. Signal information 78 is applied to the paper web 4 by means of the signal output device 48.

In addition to the representation shown in the drawing, it is, in particular, possible, for example, to arrange six paper unrolling devices, three print units, respectively arranged on top of each other, and three turning bar decks next to each other, so that this results in a plurality of draw-in options for the paper webs which are not specifically represented.

It is also possible to provide the web 1 of material with signal information outside of the web-fed rotary printing press.

This signal information can also be used for controlling cleaning processes of guide rollers, for example.

While a preferred embodiment of a method and device for drawing in a strip of material, in accordance with the present invention has been set forth fully and completely hereinabove, it will be apparent to one of skill in the art that a number of changes in, for example the structure of the paper unrolling devices, the specific types of printing units used, and the like could be made without departing from the true spirit and scope of the present invention which is accordingly to be limited only by the following claims.

What is claimed is:

1. A method for drawing a web of material through a web-fed rotary printing press including:

providing a plurality of selectable web destinations in the web-fed rotary printing press;

providing selectable paths for the web of material to travel through the web-fed rotary printing press to said selectable web destinations;

selecting one desired web destination from said plurality of selectable web destination;

providing the web of material with at least one piece of bar coded information;

providing said one desired web destination in said at least one piece of bar coded information;

providing means for reading said bar coded information provided on the web;

providing web draw-in devices useable to deliver the web of material to said plurality of selectable web destinations controlling said web draw-in devices based on said bar coded information read by said reading means; and using said controlled web draw-in devices to direct the web of material through one of said selectable paths for the web of material to travel to said selected one desired web destination.

2. The method of claim 1 further including providing web printing and web cutting means having actuating and drive means and using said bar coded information for synchronizing said web printing and cutting means.

3. The method of claim 1 further including a web cutting device, and maintaining cutting register of said web cutting device using said bar coded information.

4. A device for drawing a web of material through a web-fed rotary printing press comprising:

selectable paths of web travel in the rotary printing press;

at least one destination for the web of material drawn through said selectable paths of web travel in the rotary printing press;

at least one piece of bar coded information carried by the web, said at least one piece of bar coded information including said at least one destination for the web of material;

at least one reading device for reading said at least one piece of bar coded information on the web; and at least one web draw-in device adapted to direct the web of material along one of said selectable paths of web travel to said destination for the web of material in accordance with said bar coded information read by said at least one reading device.

5. The device of claim 4 further including at least one signal output device, said at least one signal output device providing said at least one piece of bar coded information to the web.

6. The device of claim 5 further including at least one print unit in the rotary printing press, said at least one signal output device being located before, in a direction of web travel, said at least one print unit.

7. The device of claim 4 further including at least one print unit in the rotary printing press and wherein said at least one signal reading device is located before, in a direction of web travel, said at least one print unit.

8. The device of claim 4 further including at least one print unit and one longitudinal web cutting device in the rotary printing press and wherein said at least one signal reading device is located between said at least one print unit and said longitudinal web cutting device.

9. The device of claim 4 further including a longitudinal folding device in the rotary printing press and wherein said at least one signal reading device is located before, in a direction of web travel, said longitudinal folding device.

10. The device of claim 4 wherein said at least one signal reading device is a laser scanner.

* * * * *